US008414430B2

(12) United States Patent
McKinley

(10) Patent No.: US 8,414,430 B2
(45) Date of Patent: Apr. 9, 2013

(54) APPARATUS FOR TRAINING AN ATHLETE AND METHODS OF USING THE SAME

(76) Inventor: Floyd McKinley, Milwaukee, IL (US)

( * ) Notice: Subject to any disclaimer, the term of this patent is extended or adjusted under 35 U.S.C. 154(b) by 23 days.

(21) Appl. No.: 12/909,960

(22) Filed: Oct. 22, 2010

(65) Prior Publication Data

US 2012/0100938 A1 Apr. 26, 2012

(51) Int. Cl.
*A63B 69/00* (2006.01)

(52) U.S. Cl. ..... 473/450; 473/422; 473/458; 2/161.1

(58) Field of Classification Search ..... 473/450, 473/458, 464, 59–61, 212–214, 422, 447; 2/16, 159, 161.1; D29/113, 114, 115, 116.2, D29/116.3, 117.1; 482/44–50, 121, 124; 602/21, 64

See application file for complete search history.

(56) References Cited

U.S. PATENT DOCUMENTS

| | | | | | |
|---|---|---|---|---|---|
| 2,011,362 | A | * | 8/1935 | Hayward | 473/59 |
| 3,152,337 | A | * | 10/1964 | Barry | 2/159 |
| 3,501,773 | A | * | 3/1970 | Stansberry et al. | 473/438 |
| 3,606,343 | A | * | 9/1971 | Lemon | 473/62 |
| 3,707,730 | A | * | 1/1973 | Slider | 473/450 |
| 3,888,482 | A | * | 6/1975 | Starrett et al. | 473/458 |
| 4,121,360 | A | * | 10/1978 | Vlerebome | 40/586 |
| 4,689,828 | A | * | 9/1987 | Brewer | 2/21 |
| 4,738,447 | A | | 4/1988 | Brown | |
| 4,805,905 | A | * | 2/1989 | Haub | 473/450 |
| 4,881,275 | A | * | 11/1989 | Cazares et al. | 473/450 |
| 5,135,217 | A | * | 8/1992 | Swain | 473/450 |
| 5,149,085 | A | * | 9/1992 | Sanchez | 473/450 |
| 5,188,356 | A | * | 2/1993 | Furr et al. | 473/450 |
| 5,228,682 | A | * | 7/1993 | Wolf | 473/450 |
| 5,453,064 | A | * | 9/1995 | Williams, Jr. | 482/47 |
| 5,466,215 | A | * | 11/1995 | Lair et al. | 602/21 |
| 5,500,956 | A | | 3/1996 | Schulkin et al. | |
| 5,692,242 | A | | 12/1997 | Tekerman et al. | |
| 5,697,103 | A | * | 12/1997 | Wiggins | 2/159 |
| 5,768,710 | A | * | 6/1998 | Williams | 2/161.1 |
| 5,826,276 | A | * | 10/1998 | Garceau-Verbeck | 2/161.1 |
| 6,049,910 | A | | 4/2000 | McCarter | |
| 6,203,453 | B1 | * | 3/2001 | Coddens | 473/450 |
| 6,658,669 | B1 | * | 12/2003 | Addington et al. | 473/61 |
| 6,938,274 | B2 | * | 9/2005 | Addington et al. | 2/161.1 |
| 7,437,776 | B1 | | 10/2008 | Brown | |
| 7,442,133 | B2 | * | 10/2008 | Wolf | 473/450 |
| 7,582,030 | B2 | | 9/2009 | LaPergola | |
| 7,892,194 | B2 | * | 2/2011 | Farrell et al. | 482/47 |
| RE42,895 | E | * | 11/2011 | Thiruppathi | 2/161.1 |
| 2002/0077200 | A1 | * | 6/2002 | Kreutzer | 473/450 |

* cited by examiner

*Primary Examiner* — Mitra Aryanpour
(74) *Attorney, Agent, or Firm* — Scherrer Patent & Trademark Law, P.C.; Stephen T. Scherrer

(57) ABSTRACT

An apparatus aids an athlete, such as, for example, a basketball player, in developing skills, such as dribbling, passing and shooting. Specifically, an interconnected glove portion and sleeve portion comprise a plurality of components designed to aid a basketball player in developing muscles to enhance the player's basketball skills including, for example, dribbling, passing and/or shooting. These components include, generally, a palm interfering portion to force a basketball player to utilize the fingertips on the ball during dribbling, passing and/or shooting, tension bands to strengthen muscles associated with the fingers and wrist to enhance proper handling, passing and/or shooting techniques, and one or more weights disposed in various locations on the apparatus to provide resistance training to aid in developing muscles involved with handling, passing and/or shooting a basketball.

16 Claims, 2 Drawing Sheets

APPARATUS FOR TRAINING AN ATHLETE AND METHODS OF USING THE SAME

TECHNICAL FIELD

The present invention relates to an apparatus for aiding an athlete, such as a basketball player, in developing skills, such as dribbling, passing and shooting. Specifically, the apparatus relates to an interconnected glove portion and sleeve portion having a plurality of components designed to aid a basketball player in developing muscles to enhance the player's basketball skills including, for example, dribbling, passing and/or shooting. These components include, generally, a palm interference portion to force a basketball player to utilize the fingertips on the ball during dribbling, passing and/or shooting, one or more tension bands to strengthen muscles associated with the fingers, hands and wrist to enhance proper handling, passing and/or shooting techniques, and one or more weights disposed in various locations on the apparatus to provide resistance training to aid in developing muscles involved with handling, passing and/or shooting a basketball.

BACKGROUND

The game of basketball has been played since it was invented by Dr. James Naismith in 1891. Generally, an inflated ball having a rough or tacky outer covering is dribbled and passed between teammates who attempt to shoot the ball through a ring, or basket, and obtain points. The team with the most points at the end of a set period of time is declared the winner.

Handling a basketball, whether by dribbling the basketball (bouncing the ball off the ground to allow a player to move with the ball), passing the ball through the air to another teammate, or shooting the ball in an attempt to score points by depositing the ball through the basket, requires very specific techniques.

With respect to dribbling a basketball, the best technique for maintaining control of the basketball is to use, primarily, the fingertips and not the palm of a player's hand. However, it can be very difficult to develop the muscles in a person's hand and arm that allow the player to utilize, primarily, the fingertips. Moreover, while it is generally beneficial for a player to utilize the fingertips while dribbling, a player also will want to ensure that the proper strength is applied to the ball, as well. Therefore, a player must also develop the proper muscles to utilize the fingertips and to be able to have sufficient strength to forcefully and repeatedly bounce the ball off the floor. Proper handling technique in dribbling not only requires the ability to push a ball away from a hand toward the floor during dribbling, but to also receive the ball back by the hand, specifically, the fingertips, by cradling the ball. In addition, the player may enhance ball handling during a dribble by adding spin to the ball as it flies through the air and bounces off the ground. Proper dribbling techniques further involve subtle hand and finger movements to provide sufficient power and control.

Moreover, passing the basketball also involves techniques to ensure that the basketball travels to its intended destination. Therefore, it is important for a player to ensure that the ball carries through the air with sufficient power and placement. In addition, to maneuver around players from opposing teams and to enhance the ability of a player to satisfactorily receive a basketball, subtle ball movement, including spin and arc is typically desired. Of course, this requires proper technique as well, requiring specific muscle training. It is generally known that to have proper passing technique requires a basketball player to, again, pass the ball utilizing the fingertips of the player's hand. However, strength and subtle ball movement may be imparted using the muscles of the fingers, hands and arms of the player.

Shooting the ball accurately in order to score points by depositing the ball through a basket also requires proper technique. A player will want to ensure that the basketball flies toward and through the basket with sufficient power and accuracy. As with dribbling and passing, the best technique is to utilize the fingertips, as the fingertips provide the most accuracy. In addition, a player must have sufficient strength to ensure that the basketball flies to its intended target accurately. Subtle movement of fingers, hands and arms can influence the trajectory of a ball. For example, certain types of shots require an amount of spin, to aid in the balls flight path.

Whether a basketball player is dribbling, passing and/or shooting, the basketball player must have sufficiently trained so that the ball moves consistently throughout a basketball game. This may require repeated touches on the ball. Each skill, whether dribbling, passing and/or shooting, occur many times for each player during a basketball game. Therefore, repeated drills utilizing a basketball to strengthen muscles and impart muscle memory is a keystone of proper basketball training techniques so that a player can consistently and properly handle a basketball, even when fatigued.

As with any training technique, basketball players benefit from resistance training. Generally, resistance training causes muscles to contract against an external resistance with the expectation of increases in strength, tone, mass and endurance. However, it is generally difficult to provide resistance training for basketball handling skills, as resistance training typically requires bulky weights, bands and other like equipment that may generally interfere with a basketball player's ability to handle a basketball at the same time. Generally, resistance training has, heretofore, focused purely on weight-lifting to increase the strength of muscle groups. However, weight training fails to enhance the muscle memory required to promote the training of the fine motor skills required to effectively handle a basketball when dribbling, passing and/or shooting.

For example, it is generally known that to handle a basketball requires training of particular muscles and muscle groups. While a basketball player generally wants to train all major muscle groups, some muscles are more important for dribbling, passing and/or shooting. Specifically, the biceps and triceps may be important, as well as the deltoid, brachioradialis, brochialis, extensors and flexors in the arm. Muscles in the hand and fingers may also play a large role in helping a basketball player effectively handle a basketball in dribbling, passing and/or shooting, providing stability of the arm, hand and fingers. Specifically, hand and finger muscles important in handling a basketball may include the lubricals and interossei, as well as the opponens, abductors and adductors. It is important to train each of these muscles to provide strength and stability. Proper handling technique generally enhances a basketball player's ability to hold their hand and fingers in a proper position for repeated movement to enhance strength and control of a basketball.

A need, therefore, exists for an apparatus and methods of using the same for strengthening muscles required for proper basketball handling skills, whether dribbling, passing and/or shooting a basketball. Specifically, a need exists for an apparatus and methods of using the same for strengthening the exact arm, hand and finger muscles required to enhance a basketball player's ability to dribble, pass and/or shoot.

Moreover, a need exists for an apparatus and methods of using the same that may be worn by a basketball player during training and/or during game conditions to provide the strengthening required. A need exists for an apparatus and methods of using the same for aiding a basketball player in strengthening the proper muscles that does not interfere with the basketball player's ability to interact with the basketball.

Further, a need exists for an apparatus and methods of using the same whereby a plurality of components may be utilized to train and strengthen various parts of the basketball player's arms, hands and fingers while handling the basketball. Still further, a need exists for an apparatus and methods of using the same that utilize a combination of tension bands, weights and one or more interference mechanisms to force a basketball player to utilize proper dribbling, passing and/or shooting techniques.

And, a need exists for an apparatus and methods of using the same that provide resistance training for the muscles necessary to enhance a basketball player's ability to handle a basketball. A need further exists for an apparatus and methods of using the same that provide improvements in a plurality of basketball handling techniques while dribbling a basketball when the apparatus is removed, such as ball handling, loss ball recovery control, ball speed and quickness with regular or low dribbling.

Moreover, a need exists for an apparatus and methods of using the same that provide improvements in a plurality of basketball handling techniques while passing a basketball when the apparatus is removed, such as passing with more power, speed and accuracy. Additionally, a need exists for an apparatus and methods of using the same that provide improvements in a plurality of basketball handling techniques for shooting a basketball when the apparatus is removed, such as improving shooting range and accuracy, releasing the ball quicker, and keeping the dominant shooting arm warm with increased blood flow.

Finally, a need exists for an apparatus and methods of using the same that provide improvement, generally, in hand-eye coordination, and aids in helping injuries heal faster.

SUMMARY OF THE INVENTION

The present invention relates to an apparatus for aiding an athlete, such as a basketball player, in developing skills, such as dribbling, passing and/or shooting. Specifically, the apparatus relates to an interconnected glove portion and sleeve portion having a plurality of components designed to aid a basketball player in developing muscles to enhance the player's basketball skills including, for example, dribbling, passing and/or shooting. These components include, generally, a palm interference portion to force a basketball player to utilize the fingertips on the ball during dribbling, passing and/or shooting, one or more tension bands to strengthen muscles associated with the fingers and wrist to enhance proper handling, passing and/or shooting techniques, and one or more weights disposed in various locations on the apparatus to provide resistance training to aid in developing muscles involved with handling, passing and/or shooting a basketball.

To this end, in an embodiment of the present invention, an apparatus is provided. The apparatus comprises a glove portion, the glove portion capable of being worn on a hand of a user; a tension band disposed on at least the glove portion, wherein the tension band pulls a finger of a user dorsally when worn by the user.

In an embodiment, a sleeve portion is disposed on at least a portion of the user's arm, wherein the sleeve portion is connected to the glove portion.

In an embodiment, the glove portion has a finger portion, wherein the tension band is attached to the finger portion for pulling the finger of a user dorsally when worn by the user.

In an embodiment, the apparatus further comprises a sleeve portion disposed on at least a portion of the user's arm, wherein the sleeve portion is connected to the glove portion.

In an embodiment, the tension band is disposed from the finger portion of the glove portion to a point on the sleeve portion.

In an embodiment, the sleeve portion has a distal end connected to the glove portion and a proximal end disposed opposite the distal end, wherein the tension band is disposed to the proximal end of the sleeve portion.

In an embodiment, the glove portion has a palm area, wherein an interfering material is disposed at the palm area and attached to the glove portion, wherein the interfering material protrudes a distance from the glove portion.

In an embodiment, the apparatus further comprises a second tension band disposed on the glove portion, wherein the second tension band pulls a second finger of a user dorsally when worn by the user.

In an embodiment, the glove portion includes a first finger portion and a second finger portion, and wherein the first tension band is attached to the first finger portion and the second tension band is attached to the second finger portion.

In an embodiment, the apparatus further comprises a sleeve portion disposed on at least a portion of the user's arm, wherein the sleeve portion is connected to the glove portion.

In an embodiment, the apparatus further comprises a weight attached to the glove portion.

In an embodiment, the apparatus further comprises a weight attached to the sleeve portion.

In an embodiment, the glove portion has a palm area, wherein an interfering material is disposed at the palm area and attached to the glove portion, wherein the interfering material protrudes a distance from the glove portion.

In an alternate embodiment of the present invention, an apparatus is provided. The apparatus comprises a glove portion, the glove portion capable of being worn by a hand of a user and the sleeve portion capable of being disposed on a portion of a user's arm when in use; a first tension band disposed on at least the glove portion, wherein the tension band pulls a finger of a user dorsally when worn by the user; a sleeve portion disposed on at least a portion of the user's arm, wherein the sleeve portion is connected to the glove portion; a weight attached to the sleeve portion; and wherein the glove portion has a palm area, wherein an interfering material is disposed at the palm area and attached to the glove portion, wherein the interfering material protrudes a distance from the glove portion.

In an embodiment, the apparatus further comprises a second tension band disposed on the glove portion, wherein the second tension band pulls a second finger of a user dorsally when worn by the user.

In an alternate embodiment of the present invention, a method of using an apparatus for training an athlete is provided. The method comprises the steps of providing an apparatus having a glove portion, the glove portion worn by a hand of a user and the sleeve portion disposed on a portion of a user's arm when in use, and a tension band disposed on at least the glove portion; wearing the apparatus on a hand of a user; and holding a ball in the hand, wherein the tension band pulls the finger of the user's hand away from the ball.

In an embodiment, the method further comprises providing a palm area on the glove wherein the palm area has an interfering material disposed thereon protruding from the palm area of the glove, wherein holding the ball improperly for dribbling, passing and/or shooting causes the interfering material on the palm area to contact the ball.

In an embodiment, the method further comprises the steps of: providing a sleeve portion connected to the glove portion wherein the tension band is disposed on the glove portion and at least a portion of the sleeve portion, wherein the tension band pulls a wrist of the user's hand away from the ball.

It is, therefore, an advantage of the present invention to provide an apparatus and methods of using the same for strengthening muscles required for proper basketball handling skills, whether dribbling, passing and/or shooting a basketball.

Specifically, it is an advantage of the present invention to provide an apparatus and methods of using the same for strengthening the exact arm, hand and finger muscles required to enhance a basketball player's ability to dribble, pass and/or shoot.

Moreover, it is an advantage of the present invention to provide an apparatus and methods of using the same that may be worn by a basketball player during training and/or during game conditions to provide the strengthening required.

It is an advantage of the present invention to provide an apparatus and methods of using the same for aiding a basketball player in strengthening the proper muscles that does not interfere with the basketball player's ability to interact with the basketball.

Further, it is an advantage of the present invention to provide an apparatus and methods of using the same whereby a plurality of components may be utilized to train and strengthen various parts of the basketball player's arms, hands and fingers while handling the basketball.

Still further, it is an advantage of the present invention to provide an apparatus and methods of using the same that utilize a combination of tension bands, weights and interference mechanisms to force a basketball player to utilize proper dribbling, passing and/or shooting techniques.

And, it is an advantage of the present invention to provide an apparatus and methods of using the same that provide resistance training for the muscles necessary to enhance a basketball player's ability to handle a basketball.

It is an advantage of the present invention further to provide an apparatus and methods of using the same that provide improvements in a plurality of basketball handling techniques while dribbling a basketball when the apparatus is removed, such as ball handling, loss ball recovery control, ball speed and quickness with regular or low dribbling.

Moreover, it is an advantage of the present invention to provide an apparatus and methods of using the same that provide improvements in a plurality of basketball handling techniques while passing a basketball when the apparatus is removed, such as passing with more power, speed and accuracy.

Additionally, it is an advantage of the present invention to provide an apparatus and methods of using the same that provide improvements in a plurality of basketball handling techniques for shooting a basketball when the apparatus is removed, such as improving shooting range and accuracy, releasing the ball quicker, and keeping the dominant shooting arm warm with increased blood flow.

Finally, it is an advantage of the present invention to provide an apparatus and methods of using the same that provide improvements, generally, in hand-eye coordination, and aids in helping injuries heal faster.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present embodiments, by way of example only, not by way of limitations. In the figures, like reference numerals refer to the same or similar elements.

DETAILED DESCRIPTION OF THE PRESENTLY PREFERRED EMBODIMENTS

The present invention relates to an apparatus for aiding an athlete, such as a basketball player, in developing skills, such as dribbling and shooting. Specifically, the apparatus relates to an interconnected glove portion and sleeve portion having a plurality of components designed to aid a basketball player in developing muscles to enhance the player's basketball skills including, for example, dribbling, passing and/or shooting. These components include, generally, a palm portion to force a basketball player to utilize the fingertips on the ball, and not the player's palm, during dribbling, passing and/or shooting, one or more tension bands to strengthen muscles associated with the fingers and wrist to enhance proper handling, passing and/or shooting techniques, and one or more weights disposed in various locations on the apparatus to provide resistance training to aid in developing muscles involved with handling, passing and/or shooting a basketball.

Although the present invention is described in relation to training or aiding a basketball player in developing skills, it should be apparent to one of ordinary skill in the art that the components of the present invention, as described in the embodiments presented herein, may be useful for other athletes requiring arm, hand and finger strength, such as, for example, golfers, volleyball players, soccer players (such as goal tenders), hockey players, football players, water polo players, and other like athletes.

Figure 1:
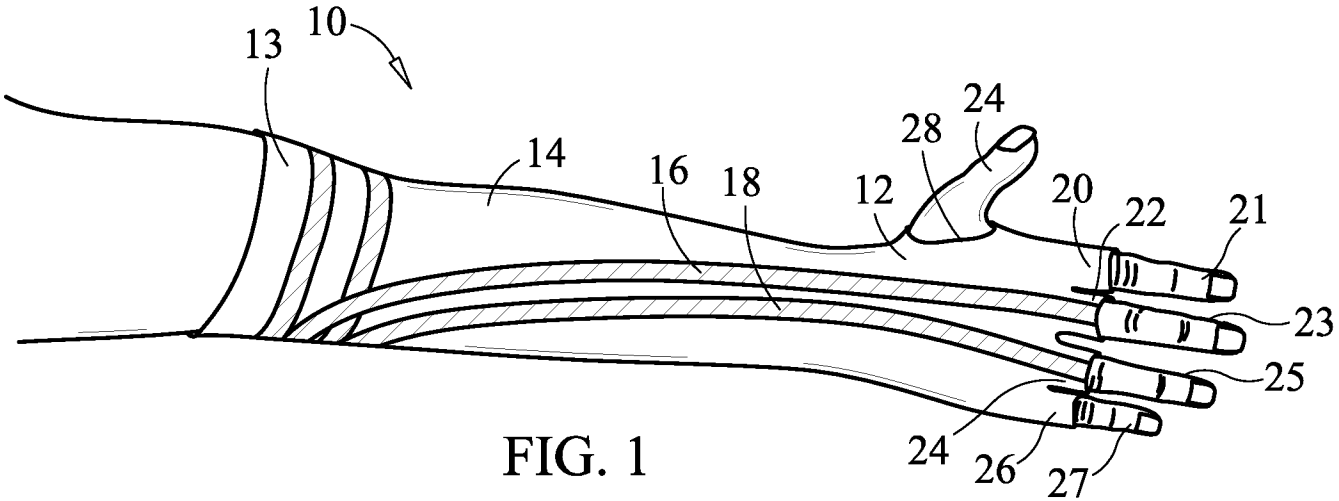
FIG. 1 illustrates a top plan view of an apparatus for training a basketball player in an embodiment of the present invention.

Now referring to the figures, wherein like numerals refer to like parts, an apparatus 10 of the present invention is provided in FIG. 1. The apparatus 10 includes a glove portion 12 and a sleeve portion 14 interconnected together to form the apparatus 10. The glove portion 12 may be integrally formed with the sleeve portion, or may be formed separately and attached together, such as via sewing or the like. The glove portion 12 and the sleeve portion 14 may be made from a stretchable elastic material, such as rubber, Spandex, LYCRA®, or another material that may be useful, such as Neoprene or another material apparent to one having ordinary skill in the art to provide the apparatus 10 with a snug fit when disposed on a user's arm and hand. As shown in FIG. 1, the glove portion 12 may include finger portions 20, 22, 24, 26. Specifically, the finger portions 20, 22, 24, 26 may partially cover fingers 21, 23, 25, 27 that may be disposed therein. It should be noted, however, that the finger portions 20, 22, 24, 26 may cover the entirety of the fingers 21, 23, 25, 27. Moreover, the glove portion 12 may further have a thumb portion 28 allowing a thumb 29 to be disposed therethrough.

Moreover, although FIG. 1 illustrates the apparatus 10 that is worn on the right hand of a user thereof, the apparatus 10 may be made to fit a left hand as well. A user of the apparatus 10 may include a single apparatus 10 on the right hand, a single apparatus 10 on the left hand, or an apparatus 10 on both the right hand and the left hand at the same time.

The apparatus 10, including the glove portion 12 and/or the sleeve portion 14, may also be useful to compress the muscles of the arms, hands and fingers, thereby keeping the muscles warm. The compression of the muscles may also reduce muscle fatigue and cramping, and may further help to prevent muscle pulls and hyperextension of the elbow and/or wrist. Preferably, the glove portion 12 and/or the sleeve portion 14 may fit tightly on the skin of the user, helping to reduce the build-up of lactic acid in the muscles, thereby providing faster recovery. In addition, the glove portion 12 and/or the sleeve portion 14 of the apparatus 10 may also reduce chafing, abrasions and other skin irritations during athletic training and/or competition.

Disposed on the glove portion 12 and the sleeve portion 14 may be a plurality of tension bands 16, 18. The tension bands 16, 18 may be made from a stretchable material, such as rubber (such as stretchable rubber bands), Spandex, LYCRA®, Neoprene, or another material having a different degree of stretch and/or elastic recovery than the material that makes up the glove portion 12 and the sleeve portion 14. Alternatively, the glove portion 12 and the sleeve portion 14 may have very little stretch and/or elastic recovery, while the tension bands, as described herein, may have a relatively large degree of elastic recovery. In addition, the tension bands 16, 18 may simply be made from elastic thread stitched into the glove portion 12 and/or the sleeve portion 14 to provide the requisite tension and resistance against the fingers, as described herein. Specifically, the tension bands 16, 18 may elastically recover to a larger extent than the material that makes up the glove portion 12 and the sleeve portion 14 such that the tension bands 16, 18, that are attached at their distal ends to finger portions 22, 24 of the glove portion 12. The tension bands 16, 18, because of their different degree of stretch and/or elastic recovery relative to the glove portion 12 and/or the sleeve portion 14, may pull the fingers 23, 25 dorsally, up and away from the palmar portion of the user's hand. Therefore, the tension bands 16, 18 provide resistance for the fingers 23, 25 such that a user must work against the constriction of the tension bands 16, 18 to hold his or her fingers 23, 25 in a position to properly hold a basketball. Specifically, it is better to hold a basketball by the fingertips of the hand of the user when dribbling, passing and/or shooting, as this provides better accuracy for the basketball. The tension bands 16, 18 work the muscles that make the fingers push palmarly toward a basketball.

The tension bands 16, 18 are shown, in FIG. 1, being attached to the finger portions 22, 24 of the glove portion 12 of the apparatus 10. However, it should be noted that any number of tension bands may be attached to the finger portions 20, 22, 24, 26. For example, a single tension band 16 may be attached to the finger portion 22. Alternatively, a single tension band 18 may be attached to the finger portion 24. In an alternate embodiment, as shown in FIG. 1, both tension bands 16, 18 may be attached to finger portions 22, 24, respectively. In a further alternate embodiment, three tension bands (not shown) may be attached to three finger portions or four tension bands may be attached to four finger portions. As noted, each of the tension bands work to pull the fingers of the user of the apparatus 10 away from a basketball held by the user's hand. The user must then work to ensure that the fingertips of the fingers are disposed on the ball, and not the palm of the user's hand.

The tension bands 16, 18 are illustrated running down the glove and to a proximal end 13 of the apparatus 10, where the tension bands 16, 18 are illustrated wrapping around the apparatus 10 anchoring the tension bands to the proximal end 13 of the apparatus 10. This may provide a greater degree of tension to the fingers 23, 25 disposed through the finger portions 22, 24 of the glove portion 12. Moreover, the tension bands 16, 18, by being disposed over or otherwise within the sleeve portion 14, may pull a wrist of the user dorsally away from a basketball held within the user's hand. The user would then have to work muscles associated with wrist position to maintain his or her fingertips on a basketball held by the user. Preferably, the tension bands run in the same general area or with the specific muscle groups and/or individual muscles in the arm, thereby providing better tension points to on the muscles by the tension bands 16, 18.

The tension bands 16, 18 may be sewn to a top of the glove portion 12 and the sleeve portion 14, thereby covering the glove portion 12 and the sleeve portion 14. Alternatively, the tension bands may be disposed beneath the glove portion 12 and the sleeve portion 14 so as not to be readily seen. Alternatively, the tension bands 16, 18 may be integrally formed with the glove portion 12 and the sleeve portion 14, or sewn into pockets contained thereon.

Moreover, although the tension bands 16, 18 are shown disposed over or otherwise within the glove portion 12 and the sleeve portion 14 of the apparatus 10, the tension bands 16, 18 may be shorter. For example, the tension bands 16, 18 may be disposed over only a section of the glove portion 12 and may stop, for example, at the wrist of the user or at a location on the sleeve portion 14. Alternatively, the tension bands may not be disposed to the finger portions of the glove portion 12, but may simply end at a location near the wrist to only supply tension to the wrist, but not the fingers. Alternatively, the tension bands may be removable from the glove portion 12, the sleeve portion 14, portions thereof, or both the glove portion 12 and the sleeve portion 14. Effectively, the tension bands may be removed altogether from the apparatus 10.

The tension bands 16, 18 may provide resistance to the proper position of the fingers of a user and/or the wrist of the user when a user is holding a basketball by the hand. Therefore, the user must work his or her muscles to maintain the proper position of the fingers and the wrist. When a user utilizes the apparatus 10 over a period of time, the user may obtain a better workout for the wrist and fingers than not utilizing the apparatus 10, whereby resistance is provided to the proper muscles and muscle groups that aid in handling the basketball during dribbling, passing and/or shooting.

In an alternate embodiment, the tension bands may have a terminal end that is removably attachable to the finger portions. For example, a terminal end of each tension band may have a slit, and a button may be disposed on the finger portions so that the tension bands may be buttoned to the finger portions when a user desires to have the tension bands provide tension. When the user wishes the tension band to not provide tension to the fingers, he or she may disconnect the tension bands from the finger portions. Of course, any manner of connecting and disconnecting the tension bands from the finger portions may be utilized, such as the aforementioned buttons, or snaps, hook-and-loop fasteners, such as Velcro® or the like.

Figure 2:
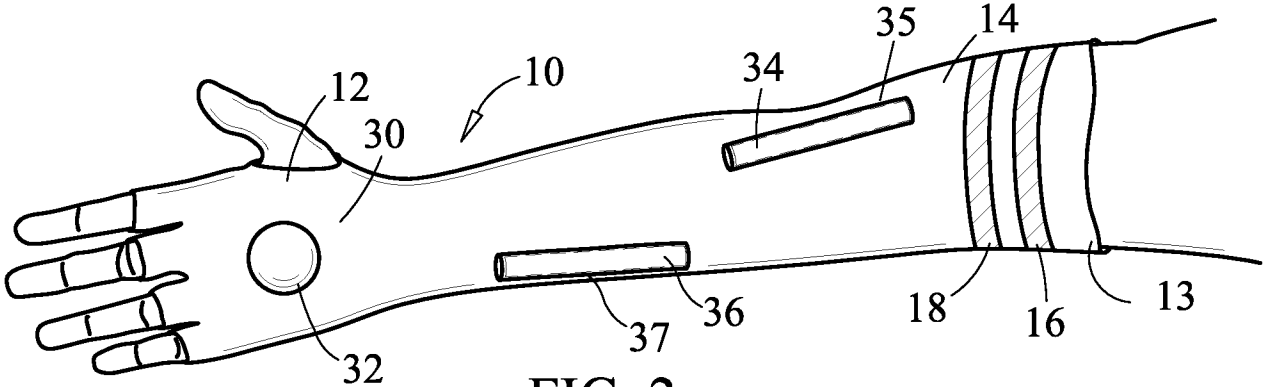
FIG. 2 illustrates a bottom plan view of the apparatus for training a basketball player in an embodiment of the present invention.

Referring now to FIG. 2, the apparatus 10 is illustrated showing a palmar side of the user's hand and forearm thereof. As illustrated, the tension bands 16, 18 are shown wrapped around the user's upper arm, specifically around the bicep thereof at the proximal end 13 thereof. The glove portion 12 may contain a palm area 30. Contained within the palm area 30 of the glove portion 12 of the apparatus 10 may be an interfering material 32. The interfering material 32 may be a rigid block, disc, rod, inflatable bladder or balloon portion, or other like material that protrudes from the palm area 30 of the glove portion 12. The interfering material 32 may be integrally formed to the palm area 30, or may be adhered thereto using an adhesive, a hook and loop fastener or any other method known to one having ordinary skill in the art to adhere the interfering material 32 to the palm area 30. Alternatively, the interfering material 32 may be disposed within a pocket (not shown) and may be removable or exchanged with a larger or a smaller interfering material, as training necessitates.

The interfering material 32 forces a user of the apparatus 10 to move the palm of his or her hand away from a basketball disposed thereon, thereby enhancing the effect of pushing his or her fingertips toward the basketball, and holding his or her wrist in the proper position. Specifically, when the user fails to hold his or her hand in the proper position, the interfering material 32 may contact a basketball held by the user. To maintain proper control of the basketball during dribbling, passing and/or shooting, the user would be required to forcefully attempt to pull his or her palm away from the basketball and move his or her fingertips closer to the basketball, thereby exercising the muscles and muscle groups necessary for proper control of the basketball.

In an alternate embodiment of the present invention, the apparatus 10 may include a clicker or a counter (not shown) that records for display the number of times the user of the apparatus 10 comes into contact with a ball, such as a basketball. The clicker or counter may detect the pressure of the ball as it hits a sensor, or may record the number of times the apparatus contacts a ball in any other way apparent to one having ordinary skill in the art. Alternatively, the sensor may simply record how many times the basketball contacts the palm portion of the user's hand, thereby informing the user how often he or she failed to use proper ball handling technique.

Still referring to FIG. 2, one or more weights 34, 36 may be disposed in various locations on the sleeve portion 14 of the apparatus 10. For example, the weight 34 may be disposed proximally on the sleeve, closer to the upper arm of the user, while the weight 36 may be disposed distally towards the hand of the user. The weights may preferably be disposed within pockets 35, 37 disposed on the sleeve portion 14 of the apparatus 10. Although only two pockets 35, 37 and, hence, only two weights 34, 36, are shown, any number of pockets may be provided on the apparatus 10 for holding one or more weights therein. Moreover, the weights contained within the pockets provided thereon may be removed and changed, thereby allowing for more or less weight to be disposed therein. Although not shown, one or more weights may be disposed on the glove portion 12 of the apparatus 12 as well, or instead of on the sleeve portion 14.

The weights 34, 36, or other weights that may be disposed in various locations on the sleeve portion 14 and/or the glove portion 12, may provide resistance for the movement of the arm of the user, thereby strengthening muscles required for ball handling control of a basketball held by the user in his or her hand, or when receiving a ball from a pass, or on a dribble.

Ideally, the apparatus 10 may be utilized by a user. Specifically, the user may wear the apparatus 10 on one or both of his or her arms to train the muscles in the arms, hands and fingers for enhancing the ball control of the user. When a user trains with one or two apparatus 10 and builds strength and muscle memory, removing the apparatus 10 may provide for enhanced handling of a basketball during dribbling, passing and/or shooting of the basketball.

Figure 3:
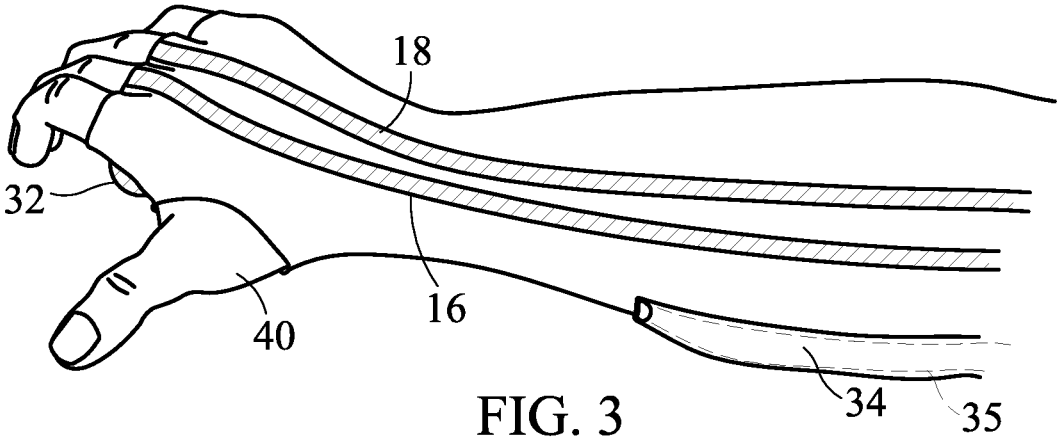
FIG. 3 illustrates an elevated perspective view of a hand of a user utilizing the apparatus in an embodiment of the present invention.

FIG. 3 illustrates a perspective view of a user's hand 40 wearing an apparatus 10, as described above. Specifically, the apparatus 10 may include the tension bands 16, 18 (although, as noted above, the present invention may include any number of tension bands to provide training to more or less than the two fingers 23, 25 described herein), the interfering material 32 and at least the weight 34 contained within the pocket 35. As illustrated, a proper position of the user's hand 40 requires bending of the user's wrist and fingers to allow the fingertips of the user's hand proper contact with a basketball. The tension bands 16, 18 resist the proper disposition of the fingers and wrist thereof, and the interfering material 32 interferes with the utilization of the user's palm on the basketball. The weight 34 provides resistance to movement of the user's arm, thereby enhancing the user's speed and strength, especially when the apparatus 10 is removed.

Figure 4:
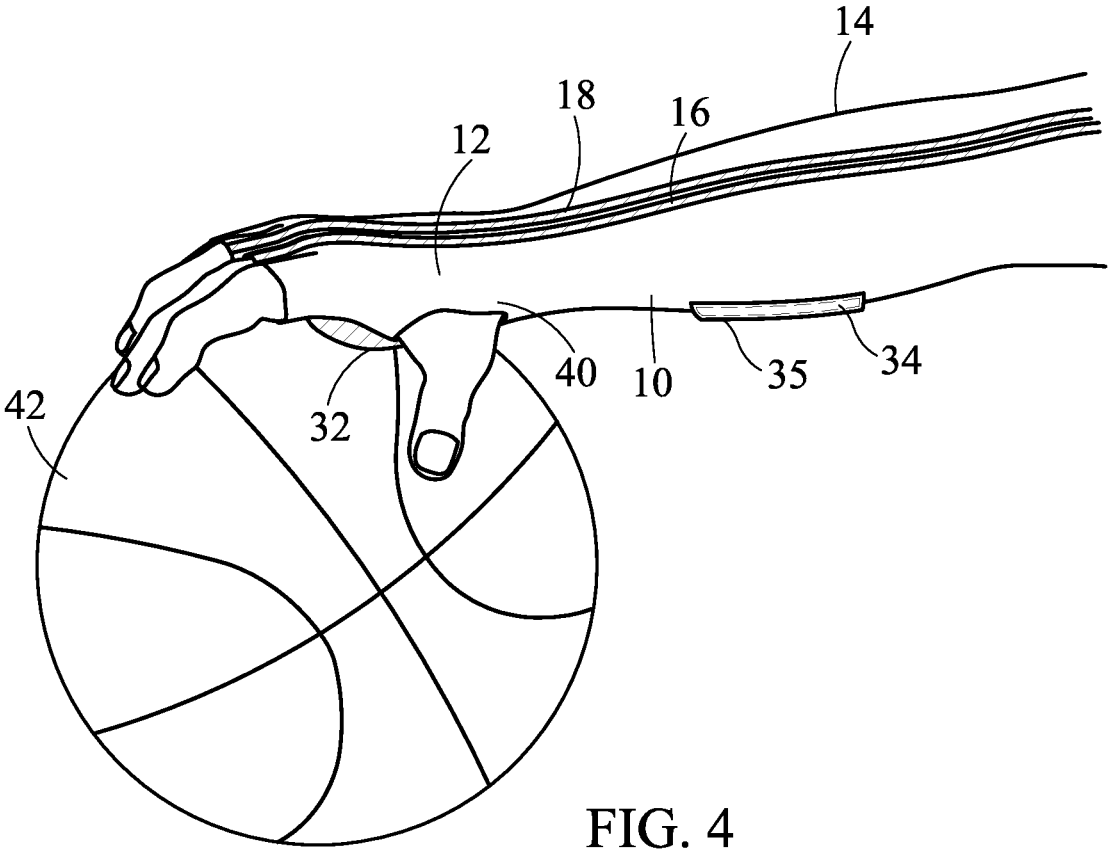
FIG. 4 illustrates a side view of a hand of a user utilizing the apparatus in an embodiment of the present invention.

Referring now to FIG. 4, the user's hand 40 is shown having proper technique for holding a basketball 42, such as when dribbling, passing and or shooting. The tension bands 16, 18 are illustrated, as well as the interfering material 32 and the weight 34 contained within the sleeve 35. As shown, the user's hand 40 has the fingertips thereof properly contacting the basketball 42 and the palm thereof disposed a distance from the basketball 42 such that the interfering material 32 does not contact the basketball. Removal of the apparatus 10 after training allows the user to better hold his or her hand in the proper position, thereby enhancing the user's ability to control a basketball during dribbling, passing and/or shooting.

Other features may be included on the glove portion 12, the sleeve portion 14, and/or on both the glove portion 12 and the sleeve portion 14. Specifically, the apparatus 10 of the present invention may have a material or be made from a material allowing perspiration to wick away from the user's skin, thereby providing more comfort for the user to wear. Moreover, certain areas or portions of the glove portion 12 and/or sleeve portion 14 may include a breathable mesh to allow the skin of the user to "breathe" or provide more comfort to the user. In addition, the glove portion 12 and/or the sleeve portion 14 may include rigid elements or reinforced areas providing durability for the apparatus 10, especially in areas that are likely to be worn due to use. For example, a durable material may be incorporated around the finger and thumb portions of the glove portion 12 where the apparatus 10 may experience a heightened amount of wear due to movement of the user's fingers and thumb, or contact with, for example, a basketball or other equipment.

The embodiments described herein may be useful in many alternate combinations. For example, the apparatus of the present invention may be provided to a user, including only the glove portion and the sleeve portion to be disposed tightly over the skin, thereby compressing the muscles and providing the advantages described above relating to the same. The apparatus of the present invention may include only the glove portion, the sleeve portion and the resistance bands providing resistance to the fingers and/or the wrist, as described herein. Alternatively, the apparatus of the present invention may simply include only the glove portion, the sleeve portion and the weights disposed on the glove portion and/or the sleeve portion. In addition, the apparatus of the present invention, including the glove portion and the sleeve portion, may also include only the interfering material, as described herein on the palm portion of the user's hand. A clicker or counter may also be provided to record the amount of times a basketball comes into contact with the apparatus of the present invention.

Alternatively, the apparatus of the present invention may include only the glove portion, the sleeve portion, the resistance bands, as described herein, and weights on the glove portion and/or the sleeve portion. Alternatively, the apparatus may include only the glove portion, the sleeve portion, the resistance bands, the weights and the interfering material on the palm portion. Moreover, the apparatus of the present invention may include only the glove portion, the sleeve portion, the resistance bands, and the interfering material on the palm portion, as described above. In an alternate embodiment, the apparatus of the present invention may include only the glove portion, the sleeve portion, the weights and the interfering material on the palm portion, as described above.

As described above, a user may wear two apparatuses of the present invention, one on each hand/arm, to train both simultaneously. The apparatuses may be identical such that both have the same number and position of tension bands, the same number and position of weights, and/or the same size and type of interfering material on the palm. Alternatively, each hand/arm of the user may have an apparatus that is different to train different aspects and/or muscles of the user. For example, the user may have an apparatus on his or her right hand having four tension bands, one for each finger, while the apparatus on his or her left hand may only have two tension bands, one for the ring finger and one for the middle finger. Each apparatus may have, generally, different numbers and tension strength tension bands, different sizes and positions of weights, and different types and sizes of interfering material on the palm of each.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. An apparatus comprising:

a glove portion, the glove portion capable of being worn on a hand of a user, the glove portion having a dorsal region, wherein the dorsal region of the glove portion is positioned on the dorsal region of the user's hand;

a sleeve portion disposed on at least a portion of the user's arm, wherein the sleeve portion is connected to the glove portion;

a weight attached to the sleeve portion; and a tension band disposed on the dorsal region of the glove portion, wherein the tension band pulls a finger of the user dorsally when the glove portion is worn by the user.

2. The apparatus of claim 1 wherein the glove portion has a finger portion, wherein the tension band is attached to the finger portion for pulling the finger of the user dorsally when the glove portion is worn by the user.

3. The apparatus of claim 2 wherein the tension band is disposed from the finger portion to a point on the sleeve portion.

4. The apparatus of claim 3 wherein the sleeve portion has a distal end connected to the glove portion and a proximal end disposed opposite the distal end, wherein the tension band is disposed to the proximal end of the sleeve portion.

5. The apparatus of claim 1 wherein the glove portion has a palm area, wherein an interfering material is disposed at the palm area and attached to the glove portion, wherein the interfering material protrudes a distance from the glove portion.

6. The apparatus of claim 1 further comprising:

a second tension band disposed on the dorsal region of the glove portion, wherein the second tension band pulls a second finger of the user dorsally when the glove portion is worn by the user.

7. The apparatus of claim 6 wherein the glove portion includes a first finger portion and a second finger portion, and wherein the first tension band is attached to the first finger portion and the second tension band is attached to the second finger portion.

8. The apparatus of claim 1 further comprising:

a weight attached to the glove portion.

9. The apparatus of claim 1 wherein the glove portion has a palm area, wherein an interfering material is disposed at the palm area and attached to the glove portion, wherein the interfering material protrudes a distance from the glove portion.

10. The apparatus of claim 5 further comprising:

a second tension band disposed on the dorsal region of the glove portion, wherein the second tension band pulls a second finger of the user dorsally when the glove portion is worn by the user.

11. A method of using an apparatus for training an athlete, the method comprising the steps of:

providing a training apparatus, the training apparatus having a glove portion, the glove portion comprising a dorsal side corresponding with a back area of the athlete's hand and an opposite palmar side corresponding with a palm of an athlete's hand;

a sleeve portion connected to the glove portion and disposed on at least a portion of the athlete's arm;

a weight attached to the sleeve portion:

a first tension band disposed on the dorsal side of the glove portion;

wearing the apparatus on a hand of the athlete, and holding a ball in the hand, wherein the tension band pulls a finger of the athlete's hand away from the ball.

12. The method of claim 11 further comprising:

providing a palm area on the glove wherein the palm area has an interfering material disposed thereon protruding from the palm area of the glove, wherein holding the ball improperly for dribbling, passing and/or shooting causes the interfering material on the palm area to contact the ball.

13. The method of claim 12 wherein the tension band is disposed on the glove portion and at least a portion of the sleeve portion, wherein the tension band pulls a wrist of the user's hand away from the ball.

14. The method of claim 11 further comprising:

a second tension band disposed on the dorsal side of the glove portion adjacent the first tension band.

15. The method of claim 11 further comprising:

an interfering member disposed at the palm side of the glove portion, wherein the interfering member protrudes a distance from the glove portion.

16. The method of claim 14 further comprising:

an interfering member disposed at the palm side of the glove portion, wherein the interfering member protrudes a distance from the glove portion.

* * * * *